United States Patent [19]

Umeda

[11] Patent Number: 4,843,766

[45] Date of Patent: Jul. 4, 1989

[54] CUTTING TOOL HAVING CONCENTRICALLY ARRANGED OUTSIDE AND INSIDE ABRASIVE GRAIN LAYERS AND METHOD FOR PRODUCTION THEREOF

[75] Inventor: Yoshio Umeda, Tokyo, Japan

[73] Assignee: Disco Abrasive Systems, Ltd., Tokyo, Japan

[21] Appl. No.: 188,663

[22] Filed: Apr. 26, 1988

Related U.S. Application Data

[63] Continuation of Ser. No. 924,522, Oct. 29, 1986, abandoned.

[30] Foreign Application Priority Data

Nov. 5, 1985 [JP] Japan ..... 60-247749

[51] Int. Cl.[4] ..... B24B 33/00

[52] U.S. Cl. ..... 51/206 R; 51/209 R; 51/20

[58] Field of Search ..... 51/206 R, 209 R; 125/20

[56] References Cited

U.S. PATENT DOCUMENTS 2,133,009 11/1936 Ballash ..... 51/209 R 3,026,655 3/1962 Osenberg ..... 51/209 R 3,153,885 10/1961 Keller et al. ..... 125/20

FOREIGN PATENT DOCUMENTS 0032492 3/1978 Japan ..... 125/20

OTHER PUBLICATIONS

Accurate Diamond Tool Corp., Cat. #72, p. 11, Sep. '72.

*Primary Examiner*—Robert P. Olszewski
*Assistant Examiner*—Lawrence Cruz
*Attorney, Agent, or Firm*—Beveridge, DeGrandi & Weilacher

[57] ABSTRACT

A cutting tool comprising a supporting base and an outside and an inside abrasive grain layer projecting concentrically from the supporting base in a radially spaced relationship, and a method for its production. The outside and inside abrasive grain layers are formed by electrodepositing abrasive grains on the supporting base and then dissolving part of the supporting base. The inner circumferential surface of the projecting portion of the outside abrasive grain layer and the outer circumferential surface of the projecting portion of the inside abrasive grain layer are smooth surfaces.

12 Claims, 4 Drawing Sheets

Fig. 9
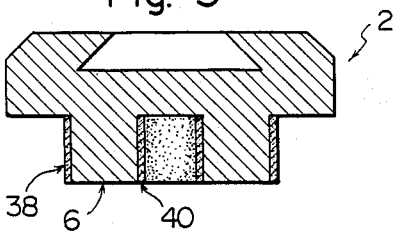
Fig. 10
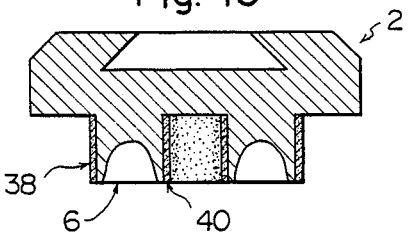
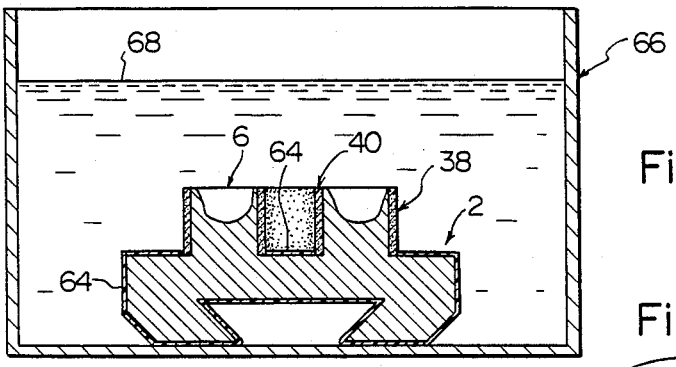
Fig. 11
Fig. 12
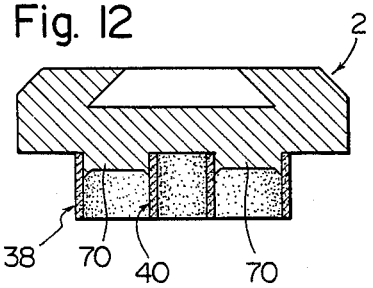
Fig. 14
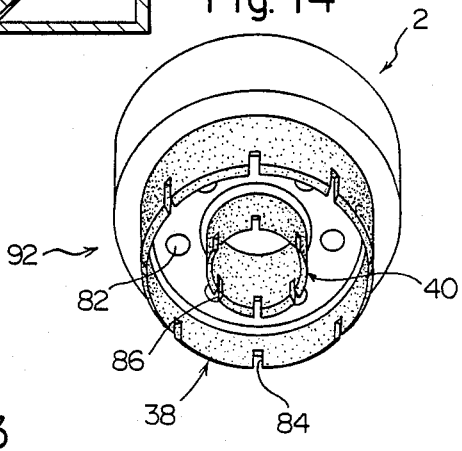
Fig. 13
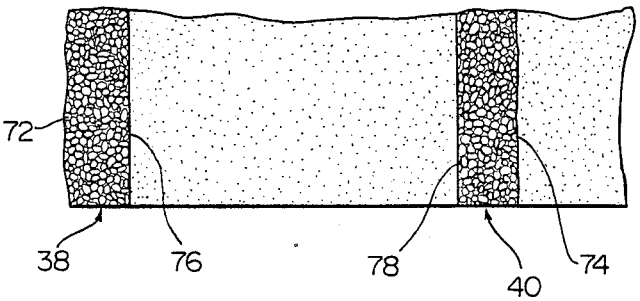

CUTTING TOOL HAVING CONCENTRICALLY ARRANGED OUTSIDE AND INSIDE ABRASIVE GRAIN LAYERS AND METHOD FOR PRODUCTION THEREOF

This application is a continuation of application Ser. No. 924,522 filed Oct. 29, 1986 abandoned.

BACKGROUND OF THE INVENTION

1. Field of the Invention

This invention relates to a cutting tool comprising a supporting base and an outside and an inside abrasive grain layer projecting from the supporting base concentrically in a radially spaced relationship, and to a method of its production.

2. Description of the Prior Art

Optical or magnetic discs have found wide commercial acceptance as an optical or magnetic recording medium. The base plate of such an optical or magnetic disc has previously been formed of a metallic material such as aluminum, but in recent years, it has been proposed to make optical or magnetic discs from glass or ceramics for various reasons including the need to increase surface flatness and smoothness.

In the production of the base plate from glass or ceramics, it is generally necessary to cut a square or rectangular glass or ceramic plate along concentric circular outside and inside cutting lines and to obtain a disc-shaped base plate remaining between the circular outside and inside cutting lines. It is important to perform the cutting along the circular outside and inside cutting lines very precisely, for example by limiting the circularity of each of the inner circumferential edge and the outer circumferential edge of the base plate and the concentricity between the two to less than several tens of micrometers to several micrometers without forming excessively large chippings, for example those having a dimension of at least 0.2 mm in an arbitrary direction, on the inner circumferential edge and/or the outer circumferential edge of the base plate.

As is well known, however, glass or ceramics have high hardness and brittleness, and are much more difficult to cut than metal. Hence, no cutting tool has been developed which can be applied to the production of a base plate for optical or magnetic discs by efficiently cutting a glass or ceramic plate.

A cutting tool of the structure disclosed in the specification of Japanese Laid-Open Utility Model Publication No. 136610/1982 may be used for cutting a glass or ceramic plate as above. This cutting tool has a cylindrical outside support and a cylindrical inside support disposed concentrically, and a plurality of arcuate grinding stone (i.e., cutting segments) formed by bonding abrasive grains with a suitable binder are bonded by silver solder to the front end of each of the outside and inside supports in a circumferentially spaced relationship. In the production of this cutting tool, it is difficult to form the cutting segments themselves with sufficient precision. It is furthermore impossible or extremely difficult to bond the cutting segments sufficiently precisely to the required positions of the front end of each of the outside and inside supports. It cannot at all be expected, therefore, that this cutting tool will meet the aforesaid requirements.

SUMMARY OF THE INVENTION

It is a primary object of this invention therefore to provide a novel and excellent cutting too which is suitable for efficiently cutting a glass or ceramic plate along concentrically arranged circular outside and inside cutting lines sufficiently precisely without producing excessively large chippings.

A second object of this invention is to provide a novel and excellent method for producing the above cutting tool.

According to this invention, there is provided a cutting tool comprising a supporting base and an outside and an inside abrasive grain layer projecting concentrically from the supporting base in a radially spaced relationship, said outside and inside abrasive grain layers being formed by electrodepositing abrasive grains on the supporting base and thereafter dissolving part of the supporting base, and the inner circumferential surface of the projecting portion of the outside abrasive grain layer and the outer circumferential surface of the projecting portion of the inside abrasive grain layer being smooth surfaces.

According to another aspect of this invention, there is provided a method of producing a cutting tool, which comprises a step of forming a supporting base having an outer circumferential surface and an inner circumferential surface arranged concentrically in a radially spaced relationship, a step of forming an outside and an inside abrasive grain layer by electrodepositing abrasive grains on the outer circumferential surface and the inner circumferential surface of the supporting base, and a step of dissolving part of the supporting base after the electrodeposition step to make the outside abrasive grain layer and the inside abrasive grain layer project concentrically from the supporting base.

BRIEF DESCRIPTION OF THE DRAWINGS

FIGS. 9 and 10 are sectional views for illustrating a polishing step and a cutting step in the aforesaid embodiment of the method of this invention for producing a cutting tool;

FIG. 11 is a simplified sectional view showing a dissolving step in the aforesaid embodiment of the method of this invention for producing a cutting tool;

FIG. 12 is a sectional view showing the supporting base and the outside and inside abrasive grain layers after the dissolving step is over;

FIG. 13 is an enlarged partial sectional view showing part of FIG. 12 on an enlarged scale;

FIG. 14 is a perspective view showing one embodiment of the finished cutting tool;

DETAILED DESCRIPTION OF PREFERRED EMBODIMENTS

The invention will be described in detail below with reference to the accompanying drawings.

Figure 1:
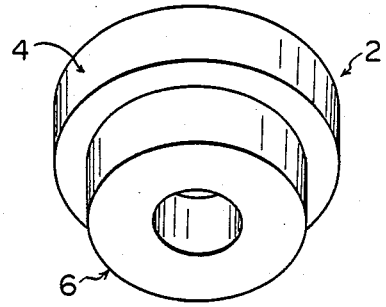
FIG. 1 is a perspective view showing a supporting base used in one embodiment of the method of this invention for producing a cutting tool.
Figure 2:
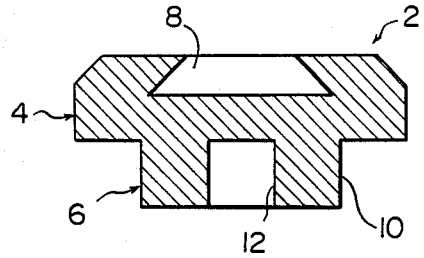
FIG. 2 is a sectional view showing the supporting base of FIG. 1.

FIGS. 1 and 2 show a supporting base 2 preferably formed of an electrically conductive metal such as aluminum. The supporting base 2 has a nearly disc-shaped main portion 4 and a hollow cylindrical protrusion 6 projecting from the lower surface of the main portion 4. A relatively large frustoconical concave portion 8 is formed centrally on the upper surface of the main portion 4. As will be described in detail hereinafter, abrasive grain layer is formed by electrodeposition on an outer circumferential surface 10 and an inner circumferential surface 12 in the protrusion 6. It is important that the outer circumferential surface 10 and the inner circumferential surface 12 of the protrusion 6 should be finished sufficiently precisely, and each should have a circularity of extremely high precision and the concentricity of the two should be sufficiently highly precise. Desirably, the circularity and the concentricity are less than several tens of micrometers, preferably less than several micrometers. In addition, it is important that the outer circumferential surface 10 and the inner circumferential surface 12 of the protrusion 6 should have a sufficiently small surface roughness represented by a maximum height $R_{max}$ defined in JIS B0621 of not more than 6.3 μm, preferably not more than 0.8 μm.

The method of producing the cutting tool in accordance with this invention comprises an electrodeposition step of electrodepositing abrasive grains on the outer circumferential surface 10 and the inner circumferential surface 12 of the protrusion 6 in the supporting base 2. Prior to the starting of electrodeposition, that part of the surface of the supporting base 2 which excludes the outer circumferential surface 10 and the inner circumferential surface 12 of the protrusion 6 is covered with a suitable electrically non-conductive material such as a known synthetic resin tape.

Figure 4:
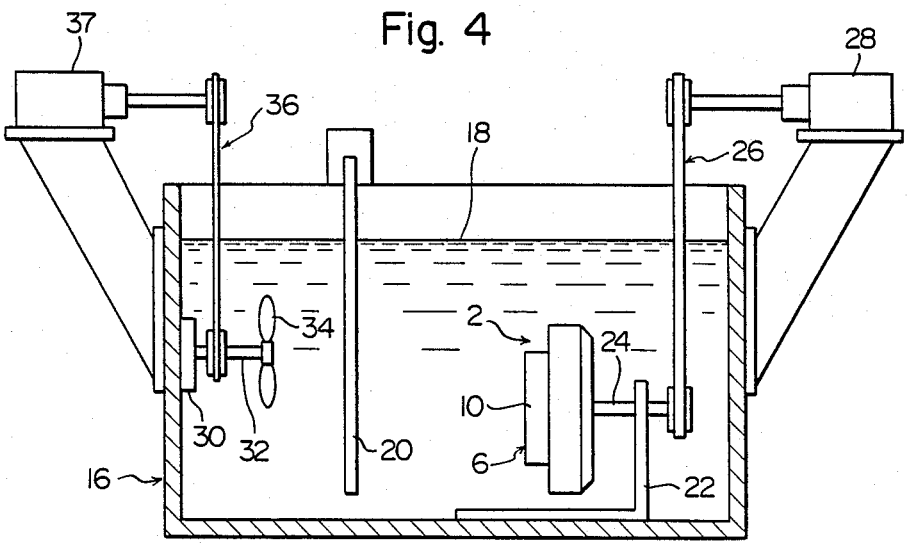
FIG. 4 is a simplified sectional view showing an example of the electrodeposition step in the aforesaid embodiment of the method of producing a cutting tool in accordance with this invention.

With reference to FIG. 4 showing one example of the electrodeposition step, an electrolytic bath 18 which may be a nickel sulfate bath is placed in an electrolytic vessel 16. The electrolytic bath 18 contains a number of abrasive grains. Preferably, the abrasive grains are natural or synthetic diamond abrasive grains or cubic boron nitride abrasive grains. The suitable particle size of the abrasive grains is U.S. mesh Nos. 200 to 300. A metal 20 to be electrolyzed which may be a nickel plate is inserted into the electrolytic bath 18, and the supporting base 2 is immersed in it. In the illustrated embodiment, a supporting frame 22 is disposed on the bottom wall of the electrolytic vessel 16, and a supporting shaft 24 is rotatably mounted on the supporting frame 22. The supporting base 2 is fixed to one end of the supporting shaft 24 by a suitable method (not shown). The other end of the supporting shaft 24 is drivingly connected to an electric motor 28 provided exteriorly of the electrolytic vessel 16 via a suitable power transmission mechanism 26 such as a belt power transmission mechanism. Within the electrolytic vessel 16 a supporting shaft 32 is rotatably mounted by a bearing means 30 fixed to the inside surface of the side wall, and a stirring vane 34 is fixed to the free end of the supporting shaft 32. The supporting shaft 32 is drivingly connected to an electric motor 37 provided exteriorly of the electrolytic vessel 16 via a suitable power transmission device 36 such as a belt power transmission mechanism. Excepting the metal 20 to be electrolyzed and the supporting base 2, various elements which make contact with the electrolytic bath 18 are made of a non-conductive material.

In the electrodeposition step, the metal 20 to be electrolyzed is connected to an anode and the supporting base 2, to a cathode. At the same time, the stirring vane 34 is rotated to stir the electrolytic bath 18 properly. Furthermore, the supporting base 2 is rotated continuously or periodically at a relatively low speed. Furthermore, the electrolytic bath 18 is heated to a temperature of about 40° to 60° C. by a suitable heater (not shown). In the electrodeposition step, the abrasive grains in the electrolytic bath 18 are successively accumulated on the outer circumferential surface 10 and the inner circumferential surface 12 of the protrusion 6 in the supporting base 2, and since the outer circumferential surface 10 and the inner circumferential surface 12 are not covered with the electrically non-conductive material 14, nickel is plated successively on the outer circumferential surface 10 and the inner circumferential surface 12. Thus, on the outer circumferential surface 10 and the inner circumferential surface 12 of the protrusion, the abrasive grains accumulated successively are cemented by nickel and an abrasive grain layer is electrodeposited. The abrasive grains could be accumulated on the other surface of the supporting base 2. But since the other surface is covered with the non-conductive material 14, nickel is not plated on the other surface, and therefore no abrasive grain layer is formed on the other surface.

Figure 5:
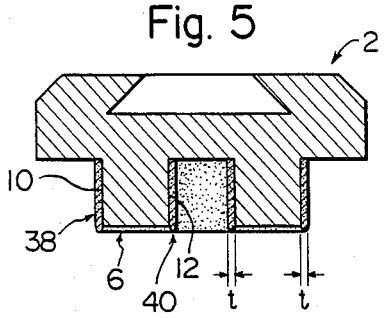
FIG. 5 is a sectional view showing an outside and an inside abrasive grain layer formed by the electrodeposition step.

When the electrodeposition step is carried out for a predetermined period of time as above, the supporting base 2 is withdrawn from the electrolytic bath 18, and the non-conductive material 14 is removed from the supporting base 2. FIG. 5 shows an outside abrasive layer 38 and an inside abrasive layer 40 formed respectively on the outer circumferential surface 10 and the inner circumferential surface 12 of the protrusion by electrodeposition. Preferably, each of the outside abrasive layer 38 and the inside abrasive layer 40 has a thickness of 0.3 to 2.0 mm, especially 0.5 to 0.7 mm. Thus, as shown on an enlarged scale in FIG. 6, in the outside abrasive grain layer 38 and the inside abrasive grain layer 40, not one but several, for example 7 to 8, abrasive grains 42 are present in the thickness direction. If the thickness of the outside abrasive grain layer 38 and the inside abrasive grain layer 40 is excessively small, a sufficient strength cannot be obtained. If it is too large, the cutting characteristics of the cutting tool are degraded owing, for example, to an increase in resistance at the time of cutting. The degree of concentration of the abrasive grains in the outside abrasive grain layer 38 and the inside abrasive grain layer 40 can be properly prescribed according, for example, to the type and particle size of the abrasive grains 42. Generally, it is conveniently set at 100 to 170. The degree of concentration of the abrasive grains can be regulated by adjusting the concentration of the abrasive grains in the electrolytic bath 18, the intensity of stirring of the electrolytic bath, etc.

Figure 7:
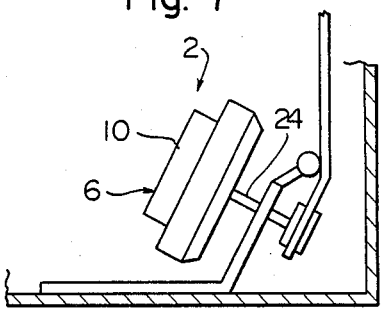
FIG. 7 is a simplified partial sectional view showing a modified example of the electrodeposition step.

FIG. 7 shows a modified example of the electrodeposition step in a simplified manner. In the modified example, accumulation of the abrasive grains on the outer circumferential surface 10 and the inner circumferential surface 12 of the protrusion 6 in the supporting base 2 is facilitated by inclining the supporting shaft 24 and inclining the protrusion 6 in the supporting base 2 upwardly toward its free end. Otherwise, the electrodeposition step shown in FIG. 7 is substantially the same as that illustrated in FIG. 4.

Figure 8:
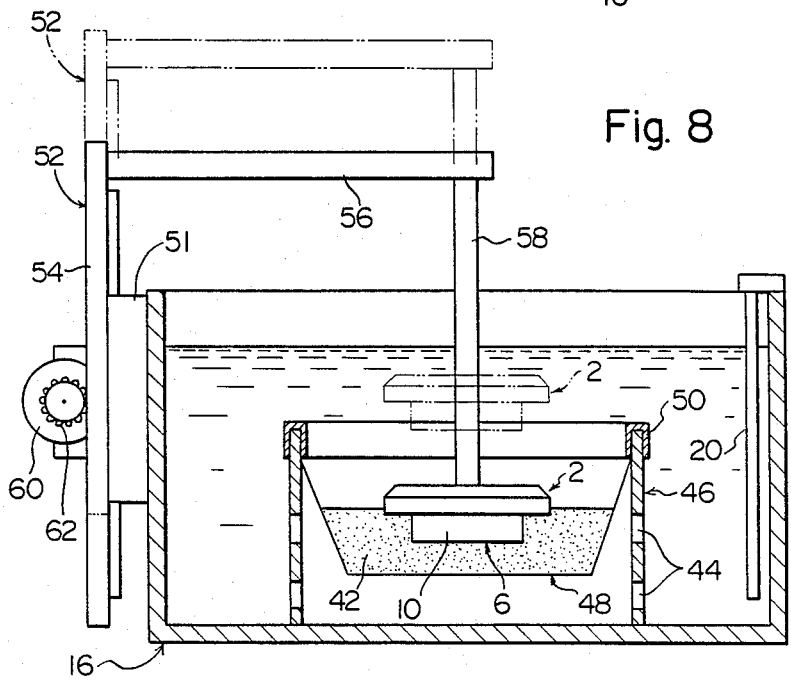
FIG. 8 is a simplified partial sectional view showing another modified example of the electrodeposition step.

FIG. 8 shows another modified example of the electrodeposition step in a simplified manner. In this modified example, a cylindrical frame 46 having a plurality of openings 44 provided therein for passage of the electrolytic bath is disposed on the bottom wall of the electrolytic vessel 16. Within the frame 46 is disposed a cup-like vessel 48 with an open top. More specifically, the upper end edge of the vessel 48 is fixed to the upper end portion of the frame 46 by a clip means 50 thereby to suspend the vessel 48 in position within the frame 46. The vessel 48 is made of a material permeable to the electrolytic bath 18 but impermeable to the abrasive grains 42, for example a cloth or Japanese paper. The abrasive grains 42 are not dispersed throughout the electrolytic bath 18 which may be a nickel sulfate bath, but are placed concentratingly in the vessel 48. A supporting frame is mounted on the outside surface of the side wall of the electrolytic vessel via a suitable supporting means 51 for free vertical movement. The supporting frame 52 has an upstanding pillar 54 extending substantially vertically, a horizontal member 56 extending substantially horizontally from the upper end portion of the upstanding pillar 54 and a suspending pillar 58 suspending substantially vertically from the end portion of the horizontal member 56. The supporting base 2 is fixed to the lower end of the suspending pillar 58. An electric motor 60 is mounted on the supporting means 51, and a pinion gear 62 is fixed to the output shaft of the motor 60. A rack is formed in the upstanding pillar 54 of the supporting frame 52, and the pinion gear 62 engages the rack. Hence, by the rotation of the electric motor 60 in a normal or a reverse direction, the supporting frame 52 and the supporting base 2 fixed thereto are moved up and down. The metal 20 to be electrolyzed which may be a nickel plate is inserted into the electrolytic bath 18 held in the electrolytic vessel 16.

Figure 3:
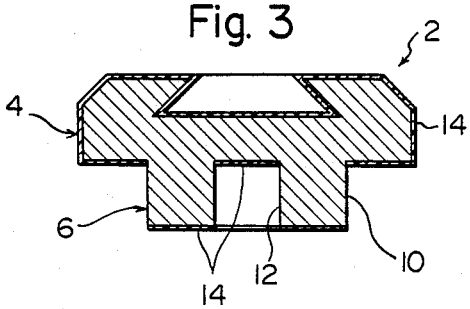
FIG. 3 is a sectional view which shows that prior to the electrodeposition step, the surface of the supporting base shown in FIG. 1 is partly covered with an electrically non-conductive material.

In the electrodeposition step, the metal 20 to be electrolyzed is connected to an anode, and the supporting base 2, to a cathode. By a suitable heater (not shown), the electrolytic bath 18 is heated to about 40° to 60° C. As a result, the supporting frame 52 and the supporting base 2 fixed thereto are periodically held at a lowered position shown by the solid line and an elevated position shown by the twodot chain line. When the supporting base 2 is held at the lowered position, relatively large amounts of the abrasive grains are accumulated on the outer circumferential surface 10 and the inner circumferential surface 12 (FIGS. 2 and 3) of the protrusion 6 of the supporting base 2 and fixed by a relatively small amount of nickel electrodeposited. When the supporting base 2 is held at the elevated position, only nickel is electrodeposited on the outer circumferential surface 10 and the inner circumferential surface 12 of the protrusion 6 of the supporting base 2 to strengthen the fixing of the abrasive grains 42 by the electrodeposited nickel. In this electrodeposition step, the degree of concentration of the abrasive grains in the resulting outside abrasive grains layer 38 and inside abrasive grain layer 40 (FIG. 5) can be adjusted by adjusting the time during which the supporting base 2 is held at the lowered position and the time during which the supporting base 2 is held at the elevated position.

In the aforesaid embodiments of the electrodeposition step, the outside abrasive grain layer 38 or the inside abrasive grain layer 40 in a simultaneously formed. If desired, it is possible to cover the inner circumferential surface 12 or the outer circumferential surface 10 of the protrusion 6 of the supporting base 6 with the electrically non-conductive material 14 and form only the outside abrasive grain layer 38 or the inside abrasive grain layer 40 in a first electrodeposition step, and thereafter in a second electrodeposition step, cover the outside abrasive grain layer 38 or the inside abrasive grain layer 40 with the non-conductive material 14 and expose the inner circumferential surface 12 or the outer circumferential surface 10 of the protrusion 6 and form the inside abrasive layer 40 or the outside abrasive layer 38 only.

Figure 6:
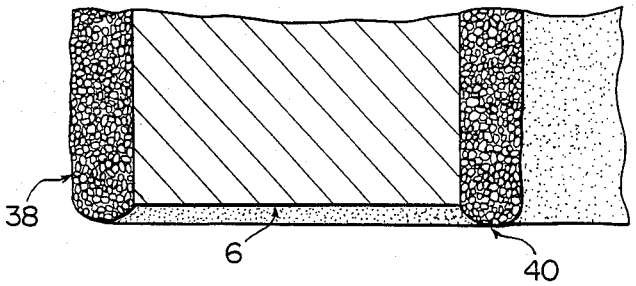
FIG. 6 is an enlarged partial sectional view showing part of FIG. 5 on an enlarged scale.

In the as-formed state of the outside and inside abrasive grain layers 38 and 40 in the electrodeposition step, the front ends of the outside and inside abrasive grain layers 38 and 40 are normally not in alignment with the front end surface of the protrusion, but project slightly downwardly beyond the front end surface of the protrusion 6 as shown in FIGS. 5 and 6. Preferably, therefore, after the electrodeposition step is over, the front end surfaces of the outside and inside abrasive grain layers 38 and 40 and the front end surface of the protrusion 6 of the supporting base 2 are polished by using a suitable grindstone such as one containing silicon carbide-type abrasive grains so that as shown in FIG. 9, the front end surfaces of the outside and inside abrasive grain layers 38 and 40 and the front end surface of the protrusion 6 of the supporting base 2 form one substantially horizontal plane.

Then, optionally, the front end portion of the protrusion 6 of the supporting base 2 is partially cut as shown in FIG. 10 by mechanical cutting. Thereafter, a dissolving step is carried out to dissolve and remove the front end portion of the protrusion 6. In one example of the dissolving step, the exposed surface of the supporting base other than the front end surface of the protrusion 6 is covered with a suitable non-soluble material 64 such as a polyester tape as shown in FIG. 11. The supporting base 2 having the outside and inside abrasive grain layers 38 and 40 formed by electrodeposition is immersed in a dissolving liquor 68 held in a dissolving vessel 66. The dissolving liquor 68 may be a liquid which does not dissolve the outside and inside abrasive grain layers 38 and 40 and the non-soluble material 64, but dissolves the supporting base 2, such as a 20% aqueous solution of sodium hydroxide if the supporting base 2 is made of aluminum. To promote dissolving, the dissolving liquor 68 is desirably heated to about 70° C. by a suitable heater (not shown). When the supporting base 2 is immersed in the dissolving liquor 68, the supporting base 2 is gradually dissolved at the front end surface of the protrusion not covered with the non-soluble material 64. In this dissolving step, it is desirable to dissolve and remove only the front end portion of the protrusion 6 leaving the base portion 70 of the protrusion 6 as shown in FIG. 12 instead of dissolving and removing the entire protrusion 6. If the entire protrusion 6 is dissolved and removed without leaving the base portion 70, the strength of bonding between the supporting base 2 and the outside and inside abrasive grain layers 38 and 40 becomes excessively low, as can be easily understood. When a required amount of the front end portion of the protrusion 6 has been dissolved and removed, the supporting base 2 is withdrawn from the dissolving liquor 68 and the non-soluble material 64 is removed. The cutting step described above with reference to FIG. 10, namely the cutting step of mechanically cutting the front end portion of the protrusion 6 partially may be omitted. But if this cutting step is carried out, it is possible to decrease the amount of the front end portion of the protrusion 6 to be dissolved and removed and shorten the dissolving time.

When the dissolving step is carried out, the base portions of the outside and inside abrasive grain layers 38 and 40 are supported by the base portion 70 of the protrusion 6 of the supporting base 2, but the front end portions of the outside and inside abrasive grain layers 38 and 40 project concentrically from the supporting base 2 without being supported thereby, as shown in FIGS. 12 and 13. The outer circumferential surface 72 of the outside abrasive grain layer 38 and the inner circumferential surface 74 of the inner abrasive grain layer 40 are the free surfaces during the electrodeposition step, and therefore are not sufficiently smooth. But since the inner circumferential surface 76 of the front end portion of the outside abrasive grain layer 38 and the outer circumferential surface 78 of the inside abrasive grain layer 40 were defined by the outer circumferential surface 10 and the inner circumferential surface 12 of the front end portion of the protrusion 6 which was dissolved, they are substantially the same smooth surfaces as the outer circumferential surface 10 and the inner circumferential surface 12 of the protrusion, namely smooth surfaces having a sufficiently small surface roughness represented by a maximum height Rmax, defined by JIS B-0621 of not more than 6.3 μm, preferably not more than 0.8 μm.

The term "smooth surface", as used with regard to the inner circumferential surface 76 of the projecting portion of the outer abrasive grain layer 38 and the outer circumferential surface 78 of the projecting portion of the inside abrasive grain layer 40 means that before being subjected to dressing to be described hereinafter, the surface has a sufficiently small surface roughness represented by a maximum height Rmax, defined by JIS B-0621, of not more than 6.3 μm.

It is important that the inner circumferential surface 76 of the projecting portion of the outside abrasive grain layer 38 and the outer circumferential surface 78 of the projecting portion of the inside abrasive grain layer 40 should be smooth surfaces, and that the abrasive grains 42 should be distributed in layer sufficiently uniformly in the inner circumferential surface 76 of the projecting portion of the outside abrasive layer 38 and the outer circumferential surface 78 of the projecting portion of the inside abrasive grain layer 40.

Figure 15:
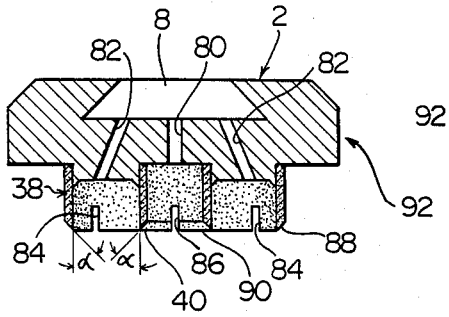
FIG. 15 is a sectional view of the cutting tool shown in FIG. 14.

With reference to FIGS. 14 and 15 showing a preferred embodiment of the cutting tool in accordance with this invention, the supporting base 2 is drilled after the dissolving step in the preferred embodiment. As a result, one central cooling liquid discharge hole 80 is formed centrally in the supporting substrate 2. The hole 80 extends downwardly from the center of the concave portion 8 and opens to a central portion surrounded by the inside abrasive grain layer 40. At the same time, a plurality of circumferentially spaced cooling liquid discharge holes 82 are bored which extend downwardly from the peripheral edge portion of the concave portion 8 in a slightly inclined fashion radially outwardly and open to a portion between the inside abrasive grain layer 40 and the outside abrasive grain layer 38.

Furthermore, in the preferred embodiment, the outside and inside abrasive grain layers 38 and 40 are further processed as follows: As shown in FIGS. 14 and 15, a plurality of circumferentially spaced cuts 84 and 86 are formed in the outside and inside abrasive grain layers 38 and 40. As clearly shown in FIG. 15, the front end portion of the outer circumferential surface of the outside abrasive grain layer 38 is processed into an inclined surface 88 inclined radially inwardly, and its front end is sharpened. Furthermore, the front end portion of the inner circumferential surface of the inside abrasive grain layer 40 is processed into an inclined surface 90 inclined radially outwardly and its front end is sharpened. As a result, a finished cutting tool is obtained. The angle α of inclination of the inclined surfaces 88 and 90 may be about 30 to 80 degrees.

The formation of the cuts 84 and 86 and the formation of the inclined surfaces 88 and 90 may be conveniently effected by applying an electrical discharge. If desired, the cuts 84 and 86 may also be formed by covering those portions of the outer circumferential surface 10 and the inner circumferential surface 12 of the protrusion 6 of the supporting base 2 which correspond to the cuts 84 and 86 with a non-conductive material during the electrodeposition step so that no abrasive grain layer is formed in the covered portions.

Figure 16:
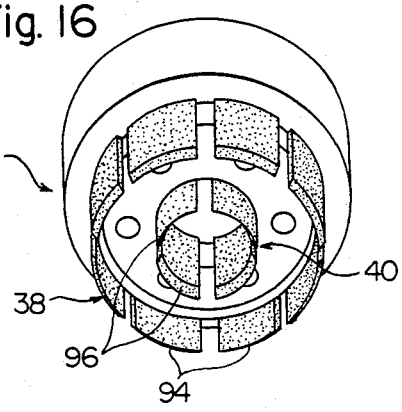
FIG. 16 is a perspective view of a modified embodiment of the cutting tool.

FIG. 16 shows a modified embodiment of the cutting tool in accordance with this invention. In the cutting tool 92 shown in FIGS. 14 and 15, the outside and inside abrasive grain layers 38 and 40 are each of a cylindrical shape continuously in the circumferential direction. In contrast, in the cutting tool 92 illustrated in FIG. 16, the outside abrasive grain layers 38 are composed of a plurality of (eight in the illustrated embodiment) circumferentially spaced arcuate pieces 94, and likewise, the inside abrasive layer 40 is composed of a plurality of (four in the illustrated embodiment) circumferentially spaced arcuate pieces 96. The outside abrasive layer 38 and inside abrasive grain layer 40 may be conveniently formed by covering the outer circumferential surface and the inner circumferential surface 12 (FIGS. 1 to 3) of the protrusion 6 of the supporting base 2 with a non-conductive material partially at circumferentially spaced intervals corresponding to the intervals of the arcuate pieces 94 and the intervals of the arcuate pieces 96 in the electrodeposition step so that no abrasive layer is formed in the covered portions.

The manner of using the cutting tool 92 constructed in accordance with this invention will be briefly described below. As illustrated in a simplified form in FIG. 17, the cutting tool 92 is fixed to the lower end of a rotating shaft 98. The concave portion 8 formed in the supporting base 2 of the cutting tool 92 communicates with a cooling liquid supply passage (not shown) formed within the rotating shaft 98. Prior to cutting of a glass or ceramic plate with the cutting tool 92, the outside and inside abrasive grain layers 38 and 40 of the cutting tool 92 are dressed. Dressing can be carried out by cutting a dresser which may be a suitable grinding stone such as a grinding stone containing silicon carbide abrasive grains with the outside and inside abrasive grain layers 38 and 40 of the cutting tool 92.

Figure 17:
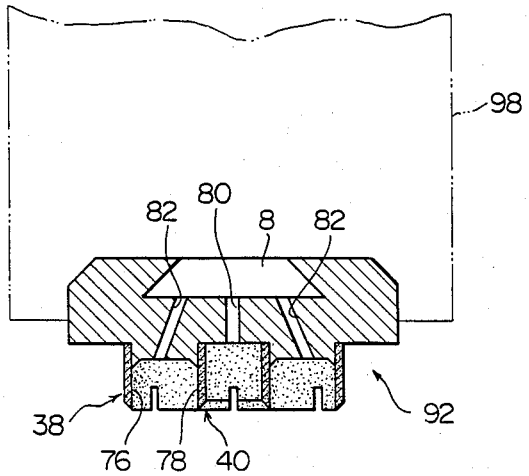
FIG. 17 is a simplified sectional view for illustrating the manner of using the cutting tool shown in FIG. 14.
Figure 17:
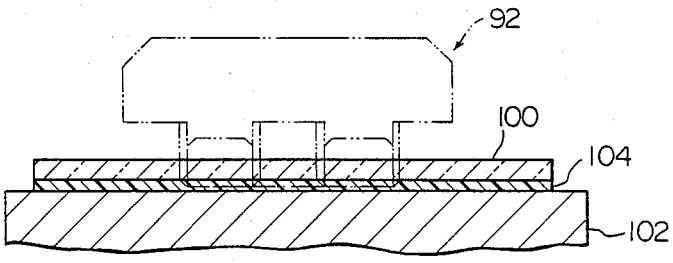

As shown in FIG. 17, a workpiece 100 such as a glass or ceramic plate to be cut is fixed to a suitable chuck table 102 by a suitable method such as vacuum adsorption. Conveniently, a plastic tape 104 (which may be the same as a known tape to be bonded to the undersurface of a semiconductor wafer when the wafer is diced) is bonded to the undersurface of the workpiece 100. In cutting the workpiece 100, the rotating shaft 98 is rotated at a high speed, and is lowered at a relatively low speed. As a result, the outside and inside abrasive grains layers 38 and 40 of the cutting tool 92 rotated at a high speed act on the workpiece 100 to cut the workpiece 100 gradually from its upper surface toward its lower surface. A suitable cooling liquid such as water is impinged from the cooling liquid discharge holes 80 and 82 to cool the outside and inside abrasive grain layers 38 and 40 and the workpiece 100. Conveniently, the cutting tool 92 is lowered to a position shown by the two-dot chain line in FIG. 17 at which the front ends of the outside and inside abrasive grain layers 38 and 40 are beyond the lower surface of the workpiece 100 and partly advance into the tape 104. Consequently, the workpiece 100 is cut along a circular outside cutting line defined by the inner peripheral surface 76 of the outside abrasive grain layer 38 and a circular inside cutting line defined by the outer circumferential surface 78 of the inside abrasive grain layer 40. When the tape 104 is peeled from the workpiece 100 after this cutting operation, a disc-shaped product is obtained of which the outer circumferential edge is defined by the circular outside cutting line and of which the inner circumferential edge is defined by the circular inside cutting line. The product can be used as a base plate of optical or magnetic discs.

In the cutting tool 92 constructed in accordance with this invention, the inner circumferential surface 76 of the outside abrasive grain layer 38 and the outer circumferential surface 78 of the inside abrasive grain layer 40 have a sufficiently precise circularity and concentricity if the circularity and concentricity of the outer circumferential surface 10 and the inner circumferential surface 12 of the protrusion 6 in the supporting base used in the electrodeposition are made sufficiently precise. Furthermore, the inner circumferential surface 76 of the outside abrasive layer 38 and the outer circumferential surface 78 of the inside abrasive grain layer 40 are sufficiently smooth if only the outer circumferential surface 10 and the inner circumferential surface 12 of the protrusion 6 of the supporting base 2 are made sufficiently smooth. Accordingly, the cutting tool 92 can cut the workpiece 100 with sufficiently precisely provided circular outside and inside cutting lines, and optical or magnetic disc base plates cut as precisely as is desired can be obtained efficiently.

While the present invention has been described in detail hereinabove with reference to preferred embodiments, it should be understood that the present invention is not limited to these specific embodiments, and various changes and modifications are possible without departing from the scope of the invention described and claimed herein.

What is claimed is:

1. A cutting tool comprising a supporting base and an outside and an inside abrasive grain layer, said layers projecting concentrically from the supporting base in radially spaced relation, said outside and said inside abrasive grain layers being formed by electrodepositing abrasive grains on the supporting base and thereafter dissolving a projecting portion of the supporting base, said outside abrasive grain layer having an inner circumferential surface with substantially the same smoothness as an outer circumferential surface of the dissolved portion of the supporting base and said inside abrasive grain layer having an outer circumferential surface with substantially the same smoothness as an inner circumferential surface of the dissolved portion of the supporting base.

2. The cutting tool of claim 1 wherein the front end portion of the outer circumferential surface of the projecting portion of the outside abrasive grain layer is inclined radially inwardly, and the front end portion of the inner circumferential surface of the projecting portion of the inside abrasive grain layer is inclined radially outwardly.

3. The cutting tool of claim 1 wherein the outside abrasive grain layer and the inside abrasive grain layer are each of a cylindrical shape continuous in the circumferential direction.

4. The cutting tool of claim 3 wherein circumferentially spaced cuts are formed in the projecting portion of the outside abrasive grain layer and in the projecting portion of the inside abrasive grain layer.

5. The cutting tool of claim 1 wherein each of the outside abrasive grain layer and the inside abrasive grain layer is composed of a plurality of arculate pieces circumferentially spaced from each other.

6. The cutting tool of claim 1 wherein a cooling liquid discharge hole at least opened between the outside abrasive grain layer and the inside abrasive grain layer is formed in the supporting base.

7. The cutting tool of claim 1 wherein the abrasive grains are natural diamond abrasive grains, synthetic diamond abrasive grains or cubic boron nitride abrasive grains.

8. The cutting tool of claim 7 wherein the abrasive grains have a particle size represented by a U.S. mesh Nos. 200 to 300.

9. The cutting tool of claim 1 wherein each of the outside abrasive grain layer and the inside abrasive grain layer has thickness of 0.3 to 2.0 mm.

10. The cutting tool of claim 9 wherein each of the outside abrasive grain layer and the inside abrasive grain layer has a thickness of 0.5 to 0.7 mm.

11. The cutting tool of claim 1 wherein the outer circumferential surface and the inner circumferential surface of the projecting portion, before dissolving thereof, have a surface roughness with maximum height of 6.3 μm, said inner circumferential surface and said outer circumferential surface of said grain layers having surface roughness with maximum heights of 6.3 μm.

12. The cutting tool of claim 1 wherein the outer circumferential surface and the inner circumferential surface of the projecting portion, before dissolving thereof, have a surface roughness with maximum height of 0.8 μm, said inner circumferential surface and said outer circumferential surface of said grain layers having surface roughness with maximum heights of 0.8 μm.

* * * * *